United States Patent [19]

De Long

[11] Patent Number: 4,611,448

[45] Date of Patent: Sep. 16, 1986

[54] POST COVER MOUNTING CLIP

[75] Inventor: Ronald B. De Long, Lowell, Mich.

[73] Assignee: Westinghouse Electric Corp., Pittsburgh, Pa.

[21] Appl. No.: 693,543

[22] Filed: Jan. 22, 1985

[51] Int. Cl.[4] ..... E04B 2/00

[52] U.S. Cl. ..... 52/239; 52/287; 52/463; 52/464; 52/761

[58] Field of Search ..... 52/126.1, 126.3, 126.4, 52/126.6, 126.7, 238.1, 239–243, 243.1, 254–256, 280, 281, 283–285, 287, 288, 312, 464, 466, 468, 578, 582, 586, 716–718, 761, 463

[56] References Cited

U.S. PATENT DOCUMENTS

| | | | |
|---|---|---|---|
| 1,311,398 | 7/1919 | Hester | 52/718 |
| 1,517,944 | 12/1924 | Bobbitt | 52/464 |
| 2,654,449 | 10/1953 | Beamer et al. | 52/287 |
| 2,766,855 | 10/1956 | Johnson et al. | 52/242 |
| 3,762,116 | 10/1973 | Anderson et al. | 52/761 |
| 4,126,978 | 11/1978 | Heller | 52/586 |
| 4,424,654 | 1/1984 | Anderson et al. | 52/761 |

FOREIGN PATENT DOCUMENTS

| | | | |
|---|---|---|---|
| 2336888 | 7/1972 | Fed. Rep. of Germany | 52/464 |
| 2451486 | 11/1980 | France | 52/489 |

*Primary Examiner*—John E. Murtagh
*Assistant Examiner*—Andrew Joseph Rudy
*Attorney, Agent, or Firm*—B. R. Studebaker

[57] ABSTRACT

A spring clip for resiliently retaining a post cover in place between a pair of space dividing wall panels interconnected and supported by a cylindrical support post disposed therebetween. Detents on the spring clip retain flanges on the post cover to complementary flanges on the adjacent ends of the wall panels.

1 Claim, 5 Drawing Figures

POST COVER MOUNTING CLIP

CROSS-REFERENCE TO RELATED APPLICATIONS

This invention is directed to an improved mounting clip for use in connection with the post cover described in copending Application Ser. No. 582,207, filed Feb. 21, 1984 for "Post Cover For A Space Dividing Wall Panel System", owned by the assignee of this invention.

BACKGROUND OF THE INVENTION

This invention relates to space dividing wall panel systems of the type employed in the modern open office, and more particularly to a spring clip for securing a post cover to space dividing wall panel systems employing cylindrical support posts to interconnect and support the spacing dividing wall panels.

A commercially successful space dividing wall panel system employing cylindrical support posts is disclosed in U.S. Pat. No. 3,762,116 to William C. Anderson et al for a "Space Divider System and Connector Assembly Therefor". Although the modularity of the post and panel system as well as its ready adaptability for configuration modification in terms of minor changes to the office layout as well as substantial redesign of the entire office is a substantial asset, the aesthetic appeal of this system has sometimes been questioned. The above-referenced copending application is directed to a post cover which eliminates the appearance of the round post interposed between adjacent space dividing wall panels. In addition to hook-shaped connectors which fit into annular slots in the support post in a manner similar to that which is employed in connecting the panels to the post, retention means in the form of an adhesive-coated or metal impregnated magnetized vinyl strip was employed to maintain the elongated thin post cover in intimate relationship with the post over its entire length.

Questions have been raised with regard to the effect of magnetized strips in an office environment where magnetically erasable tapes and computer discs are employed. Furthermore, adhesive strength can be a problem through too little or too great adhesion of the vinyl strip to the post.

In order to eliminate any possibility of a wavy or bowed appearance being created in the post cover a positive, easily releasable, retention means is desirable along the length of the post cover and which is preferably non-magnetic.

SUMMARY OF THE INVENTION

In accordance with the present invention a plurality of spring clips are employed in combination with a space dividing wall panel system which includes at least a pair of space dividing wall panels having vertical side rails with inwardly directed angled flanges thereon, a support post interconnecting and supporting the panels disposed therebetween and a post cover having complementary angled flanges spanning the space between the rail flanges on adjacent sides of the wall panels. The spring clips have resilient detent means thereon constructed and arranged to releasably secure the flanges on the post cover to the flanges on the panel side rails to thereby retain the post cover in a planar relationship with the adjacent wall panels. The support posts are cylindrical and the spring clip has a complementary curved surface in contacting relationship with the cylindrical post and includes a central body portion having curved resilient detent means on each side thereof and leg portions extending laterally from the body portion with each of the leg portions having detent means juxtapositioned the curved resilient detents. The flanges on the side rails and the flanges on the post cover are disposed between the curved resilient detent and a pair of said juxtapositioned detent means on each side of the post cover.

BRIEF DESCRIPTION OF THE DRAWING

Many of the attendant advantages of the present invention will become readily apparent and better understood as the following detail description is considered in connection with the accompanying drawing in which.

DESCRIPTION OF THE PREFERRED EMBODIMENT

Figure 1:
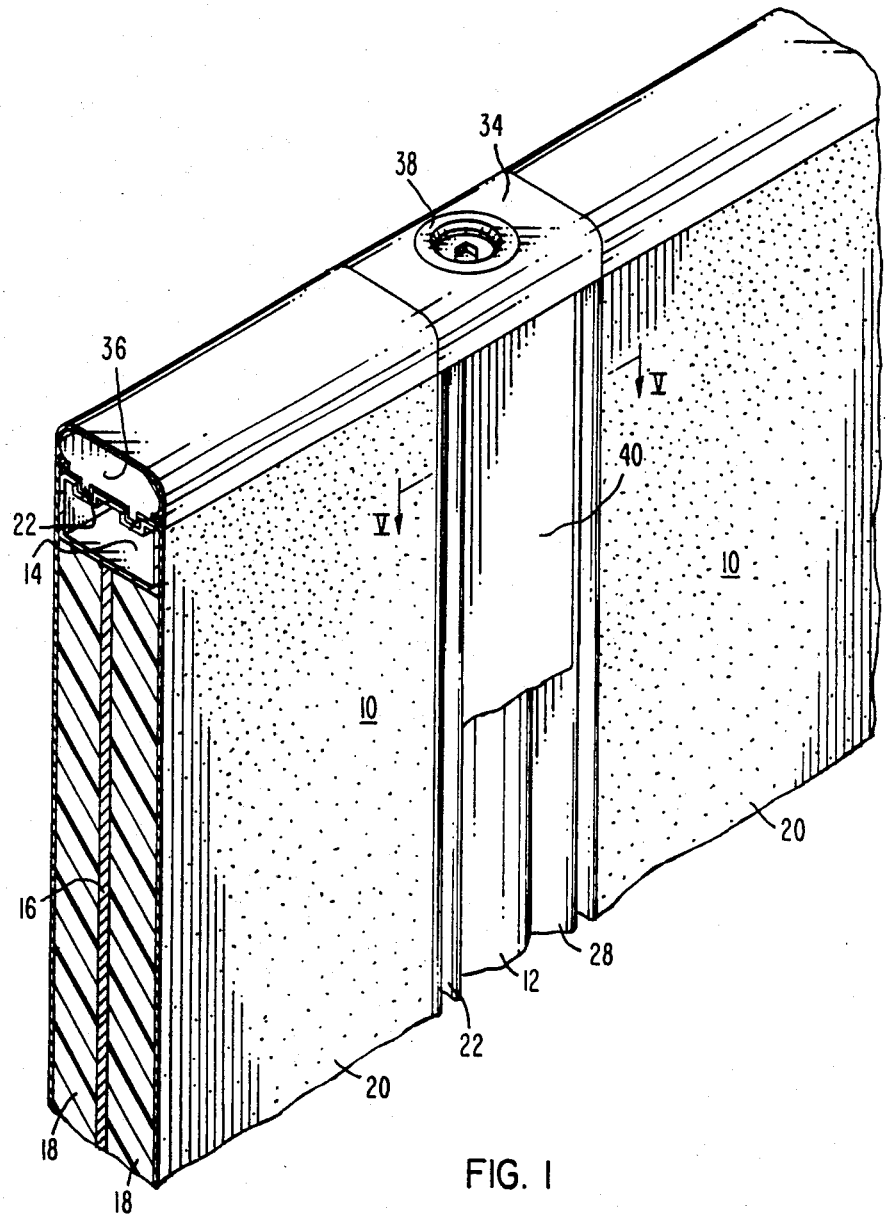
FIG. 1 is a perspective view partly in section of a space dividing wall panel system employing a cylindrical post in combination with a post cover.
Figure 2:
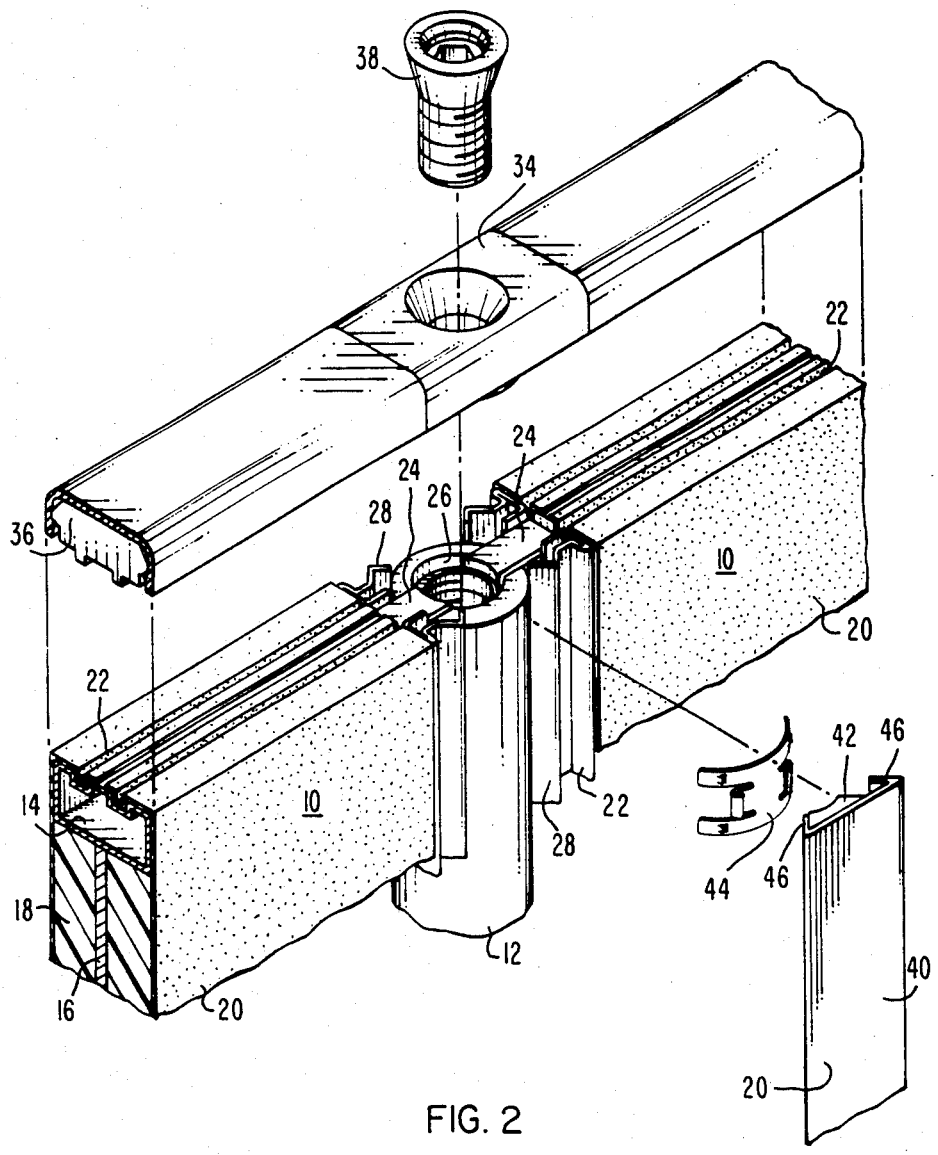
FIG. 2 is an exploded view of the space dividing wall panel system of FIG. 1.

Referring now in detail to the drawing wherein like reference characters represent like parts throughout the several views there is illustrated in FIGS. 1 and 2 a rigidized space dividing wall panel system which includes a pair of space dividing wall panels 10 interconnected and supported by a cylindrical support post 12. The space dividing wall panels 10 include a tubular frame member 14 which generally surrounds, for example, a plywood or the like panel septum 16 having on each side thereof fiberglass batting 18 covered by a fabric 20 or alternatively, in some cases, a decorative plastic laminate.

The wall panels 10 have secured at their lateral edges to the frame members 14 a slotted standard or end rail 22 each of which have associated therewith hook-shaped connectors 24. As can be best seen in FIG. 2 the hook-shaped connectors 24 on the side edges of the wall panels interact with an annular ring 26 at the upper end of the tubular post 12, to interconnect and support the space dividing wall panels. Obviously, similar hook-shaped connectors are employed at the base of the panel adjacent the bottom end of the post to connect the wall panels to the cylindrical post in the manner disclosed in the aforementioned U.S. Pat. No. 3,762,116. The slotted standard or end rails 22 include a pair of converging flanges 28 which extend inwardly toward the post 12 at an angle of approximately 45° from the plane of the panels' outer surface.

The panels are secured together and to the post 12 through a panel rigidizer 32 which includes a central hub portion 34 and a pair of laterally extending leg portions 36. A threaded post cap or hub screw 38 extends through an aperture in the rigidizer hub portion 34 and is threaded into the top of the post 12. The interconnection of the panels, post and rigidizer is described in detail in copending U.S. patent application Ser. No. 618,630, now abandoned, filed June 8, 1984 for "Panel Rigidizer" and owned by the assignee of this invention.

In order to shield the post 12 from view and give a uniform planar appearance to the space dividing wall panel system, a post cover 40 is provided which includes upper and lower hook-shaped connectors 42 which coact with the post in the same manner as the hook-shaped panel connectors 24 to mount the post cover to the system. The post cover 40 includes inwardly directed flanges 46 and the entire post cover including the flanges 46 is preferably covered by the same fabric 20 as the adjacent wall panels. Because of the length and the relatively thin construction of the post cover there is a tendency for the post cover to bow or wave over its length and it is desirable to provide additional means for securing the post cover to the post and panel system over the post cover length. As disclosed in the aforementioned copending post cover patent application Ser. No. 582,207, the additional securing has been accomplished by adhesive coated or metal impregnated magnetized vinyl strips. In accordance with the present invention, a plurality of spring clips 44 are employed over the length of the post cover to secure flanges 46 on the post cover 40 to the flanges 28 on the slotted standard or end rail 22.

Figure 4:
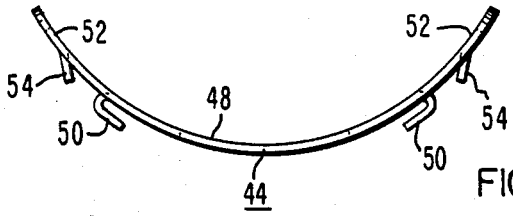
FIG. 4 is a side elevation view of the spring clip of this invention.
Figure 3:
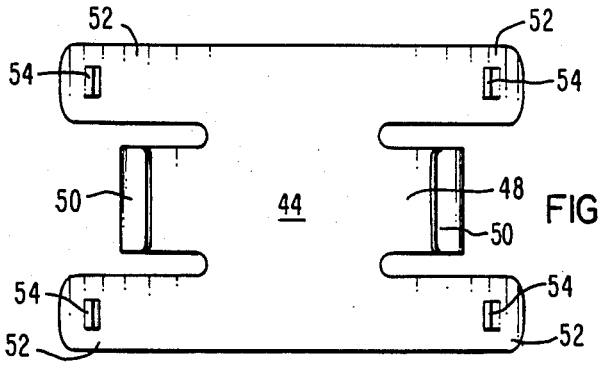
FIG. 3 is a top plan view of the spring clip of this invention.

As best seen in FIGS. 3 and 4, the spring clip 44 preferably of curved spring steel includes a central body portion 48 having curved resilient detents 50 extending from the convex side thereof and lateral leg portions 52 each having a detent 54 thereon also extending from the convex side thereof.

Figure 5:
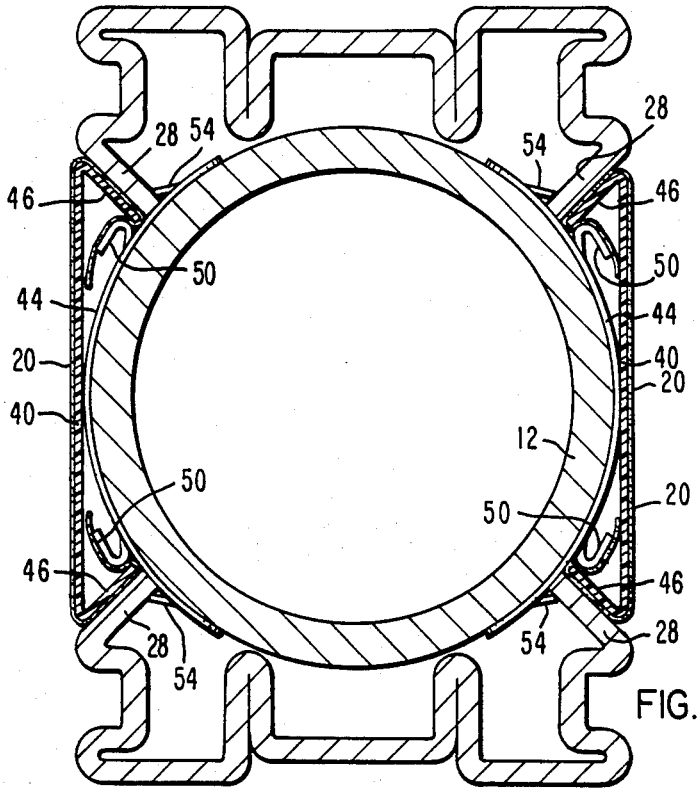
FIG. 5 is a partial section view taken along the line V—V of FIG. 1.

As can be best seen in FIG. 5, the spring clip 44 has substantially the same radius of curvature as the support post 12 and the inwardly directed flanges 46 on the post cover 40 extend inwardly at an angle of approximately 45° to the surface of the post cover and are complementary to the flanges 28 on the end rail 22. The spring clip 44 is mounted between the ends of the flanges 28 and the post 12 with the detents 54 abutting the inner side of the flange 28 leaving the curved detents 50 situated adjacent the outer surface of the flanges 28. When the post cover 40 is mounted to the post 12 through hook connectors 42, pressure on the outer surface of the post cover will cause the flanges 46 to be urged into the space between the outer surface of the flange 28 and the resilient curved detent 50 thereby resiliently retaining the flange 46 against the flange 28 and secure the post cover 40 to its adjacent panels. The fabric 20 on the post cover flanges 46 augment the frictional retention but is not critical to operative retention of the post cover by the spring clips.

It is preferable that the spring clips 44 be employed at intervals of about 18 inches over the length of the post cover to thereby inhibit any tendency for the post cover to become bowed or wavy after installation.

As will be apparent from the foregoing the spring clips of this invention provide positive mechanical retention of the post cover to the post and panel system without resorting to adhesives or magnetized materials and permits the post covers to be quickly and easily removed when it is desired to restructure the office configuration.

What is claimed is:

1. In combination with a space-dividing wall panel system which includes at least a pair of space dividing wall panels having vertical side rails with inwardly directed angled flanges thereon, a cylindrical support post interconnecting and supporting said panels disposed therebetween and a post cover spanning the space between said rail flanges on adjacent sides of said panels, said post cover having complementary angled flanges thereon in mating engagement with the angled flanges on said side rails, the improvement which comprises;

a plurality of curved spring clips in contacting relationship with said cylindrical support posts, each of said spring clips including a central body portion having curved resilient detent means thereon and a pair of leg portions extending laterally from each side of said body portion with each of said leg portions having detent means juxtapositioned said curved resilient detent means, said mating flanges on said rails and said post cover being disposed between said resilient detent means and a pair of said juxtapositioned detent means whereby said post cover is thereby secured to said space dividing wall panels in a planar relationship therewith.

* * * * *